US005934838A

United States Patent [19]

Egan

[11] Patent Number: 5,934,838

[45] Date of Patent: Aug. 10, 1999

[54] MODULAR WALL BLOCK RETAINING WALL REINFORCED BY CONFINEMENT CELLS FOR CUT WALL APPLICATIONS

[75] Inventor: Philip D. Egan, Atlanta, Ga.

[73] Assignee: The Tensar Corporation, Atlanta, Ga.

[21] Appl. No.: 08/883,078

[22] Filed: Jun. 26, 1997

[51] Int. Cl.[6] ..... E02D 29/02

[52] U.S. Cl. ..... 405/262; 405/284; 405/286

[58] Field of Search ..... 405/262, 284, 405/285, 286

[56] References Cited

U.S. PATENT DOCUMENTS

| | | | |
|---|---|---|---|
| D. 274,762 | 7/1984 | Toffolon . | |
| 4,011,728 | 3/1977 | Turzillo . | |
| 4,050,254 | 9/1977 | Meheen et al. . | |
| 4,196,161 | 4/1980 | Toffolon et al. . | |
| 4,251,196 | 2/1981 | Toffolon et al. . | |
| 4,324,508 | 4/1982 | Hilfiker et al. . | |
| 4,341,491 | 7/1982 | Neumann . | |
| 4,351,507 | 9/1982 | Toffolon et al. . | |
| 4,372,091 | 2/1983 | Brown et al. . | |
| 4,374,798 | 2/1983 | Mercer . | |
| 4,474,400 | 10/1984 | Toffolon . | |
| 4,530,622 | 7/1985 | Mercer . | |
| 4,616,959 | 10/1986 | Hilfiker | 405/286 |
| 4,661,023 | 4/1987 | Hilfiker | 405/286 |
| 4,684,294 | 8/1987 | O'Neill | 405/286 |
| 4,685,838 | 8/1987 | Curt . | |
| 4,707,962 | 11/1987 | Meheen . | |
| 4,728,227 | 3/1988 | Wilson et al. . | |
| 4,824,293 | 4/1989 | Brown et al. . | |
| 4,914,887 | 4/1990 | Meheen . | |
| 4,929,125 | 5/1990 | Hilfiker . | |
| 5,131,791 | 7/1992 | Kitziller . | |
| 5,190,413 | 3/1993 | Carey . | |
| 5,259,704 | 11/1993 | Orgorchock . | |
| 5,320,455 | 6/1994 | Mattox . | |
| 5,378,088 | 1/1995 | Foehrkolb . | |
| 5,484,235 | 1/1996 | Hilfiker et al. | 405/262 |
| 5,505,563 | 4/1996 | Curt . | |
| 5,522,682 | 6/1996 | Egan . | |
| 5,540,525 | 7/1996 | Miller et al. . | |
| 5,568,998 | 10/1996 | Egan et al. . | |
| 5,568,999 | 10/1996 | Egan et al. . | |
| 5,580,191 | 12/1996 | Egan . | |
| 5,595,460 | 1/1997 | Miller et al. . | |
| 5,788,424 | 8/1998 | Torch | 405/262 |

OTHER PUBLICATIONS

Brochure, "Terre–Link Cellular Earth Retaining Structures" (28 pgs.)

Brochure, DOUBLEWAL The Interlockign Precast Gravity Wall System.

Brochure, T–WAll "Construction Procedures".

Brochure, Tensar "Concrete GeoWall Package".

*Primary Examiner*—Tamara L. Graysay
*Assistant Examiner*—Frederick L. Lagman
*Attorney, Agent, or Firm*—Jacobson, Price, Holman & Stern, PLLC

[57] ABSTRACT

Precast modular concrete wall blocks are assembled to form a retaining wall in front of a limited depth cut wall face. Arched confinement cells are formed behind the courses of blocks by sections of vertically oriented sheet material for reception and retention of a particulate fill material. Each wall block is provided with a channel or slot for attaching opposed edge portions of the cell-forming sheets of material to the rear surfaces by an interference fit or by comb-like grid connecting devices to define generally semi-circular confinement cells to reinforce the retaining wall. The fill material uniformly flexes the cell-forming sheet material and also surrounds the space between the confinement cells and cut wall face.

16 Claims, 8 Drawing Sheets

MODULAR WALL BLOCK RETAINING WALL REINFORCED BY CONFINEMENT CELLS FOR CUT WALL APPLICATIONS

FIELD OF THE INVENTION

The present invention is concerned with producing a retaining wall in a cut wall environment of limited depth. The retaining wall is formed by a plurality of precast modular wall blocks forming vertically stacked courses of a retaining wall to which are secured confinement cells, preferably made of grid-like sheets of material, secured to selected spaced blocks in one or more courses.

BACKGROUND OF THE INVENTION

Retaining walls are commonly used for architectural and site development applications. The wall facing must withstand very high pressures exerted by backfill soils. Reinforcement and stabilization of the soil backfill in mechanically stabilized earth applications is commonly provided by grid-like sheet materials that are placed in horizontally extending layers in the soil fill behind the wall face to interlock with the soil and create a stable reinforced soil mass. Connection of the reinforcing material to the elements forming the wall face holds the wall elements in place and resists soil backfill pressures.

A preferred form of grid-like tie-back sheet material used to reinforce the soil behind a retaining wall structure, known as an integral geogrid, is commercially available from The Tensar Corporation of Atlanta, Ga. ("Tensar") and is made by the process disclosed in U.S. Pat. No. 4,374,798 ("the '798 patent"), the subject matter of which is incorporated herein in its entirety by reference. Integral geogrid tie-back sheet material may be uniaxially oriented according to the '798 patent to provide grid-like sheets including a plurality of elongated, parallel, molecularly oriented strands with transversely extending bars integrally connected thereto by less oriented or unoriented junctions, the strands, bars and junctions together defining a multiplicity of elongated openings. With biaxial stretching the bars may be oriented into elongated strands. While integral geogrids are preferred as reinforcing materials in the construction of retaining walls, other forms of tie-back sheet materials have been used in a similar manner.

Use of pre-cast concrete structures for wall-facing elements in a retaining wall traditionally requires an area behind the retaining wall of approximately 70% of the total wall height. This clearance area is required to accommodate the horizontally extending geogrid extending rearwardly into the fill material to anchor the wall. However, in some environments, only a limited depth of excavation is possible due to preexisting conditions, such as buried utility lines or the presence of a rock face, for example. Accordingly, alternate systems have been developed to accommodate a limited depth excavation for erection of a retaining wall. These limited depth excavations are referred to as a "cut wall" operation.

One known system for erecting a retaining wall in a cut wall environment of limited depth, is commercially available under the trade name DOUBLEWAL®. Discussion of this system is included in U.S. Pat. Nos. 4,196,161, 4,251,196, 4,351,507, 4,372,091, 4,474,400 and D-274,762, the subject matter of each of which is incorporated herein by reference for further background.

The DOUBLEWAL® system confines a significant mass of soil fill in massive concrete structural units having a pair of spaced side panels interconnected by connecting arms spaced inwardly from the ends of the side panels. By positioning adjacent structural units together, a series of approximately square shaped boxes are formed for receipt of the fill material.

A mortise-tendon connection is formed between superimposed units stacked vertically so that a vertically recessed mortise at the bottom of each superimposed connecting arm fits within a complementary shaped vertically projecting tendon at the top of each arm of a lower course of structural units. The units may be stacked vertically in alignment or in horizontally staggered rows with horizontal displacement between units and adjacent rows equal to approximately one half the length of a unit. The stacked units provide columnar openings which are filled for added structural integrity of the wall so as to form a gravity type wall.

Another system for erecting a retaining wall in a limited depth, cut wall environment is commercially available under the name T-WALL and is described in U.S. Pat. No. 4,684,294, the subject matter of which is also incorporated herein by reference for background. In this system, a concrete form includes a front face and a centrally located, rearwardly projecting stem. The stem extends into and firmly engages with a soil mass located behind the front face. Nothches in the stem provide for interengagement with support beams in the soil mass.

Granular backfill material is deposited directly on top of the stems so as to charge the compartments formed on opposite sides of the stems with equal amounts of backfill material and to prevent lateral movement of the concrete form. It is also desirable to include shear keys in a space created between teeth on the top and bottom surfaces of two superimposed stems. The purpose of these keys is to prevent movement of the unit during backfill operations.

In related application Ser. No. 08/461,850, filed Jun. 5, 1995, and assigned to Tensar, now U.S. Pat. No. 5,697,735 issued Dec. 16, 1997 the subject matter of which is incorporated herein in its entirety by reference, a system of retaining interconnected concrete panel wall elements by hoops of vertically extending sheets of grid-like material which form cells to confine fill material, is disclosed. While that system provides significant advantages in the construction of retaining walls in a cut wall environment, the large concrete wall panels themselves are cumbersome, involving complex and expensive manufacturing techniques, and requiring heavy construction equipment and skilled personnel to properly lift and place each panel. Thus, while this system is an improvement over the DOUBLEWAL® and T-WALL systems, and other systems for reinforcing concrete panel retaining walls when used in an area of limited depth, it has limited application.

In other environments, some of the disadvantages associated with the construction of concrete panel retaining walls, have been overcome with the use of modular concrete wall blocks which are relatively inexpensive to manufacture and can be stacked by a single individual, much like bricks, in superimposed, usually staggered, courses. A preferred modular wall block system for erecting a retaining wall is described in U.S. Pat. Nos. 5,540,525 and 5,595,460 assigned to Tensar, the subject of each of which is also incorporated herein by reference. In these patents, when the retaining wall is to be reinforced, horizontally extending tie-back sheets, such as the integral geogrids referred to above, are secured between selected courses of the wall blocks. To attach the geogrid, each of the wall blocks is provided with a recessed area in its upper surface, including a trough or groove adapted to receive and retain a comb-like rigid grid connection device formed of any suitable material, preferably a high strength polymer. The grid connection device includes a crossbar or spine interconnecting a multiplicity of perpendicularly extending spaced finger elements which are engaged through the openings in the end portion of the sheet of geogrid. The finger elements are forced into frictional engagement with the side wall portions of the trough and may include serrations along the edges of the finger elements to thereby securely locking the device in place. The crossbar of the connection device overlies the rearwardly extending strands of the geogrid thereby retaining the geogrid against the top surface of the block.

In the system of the '525 and '460 patents, the sheets of geogrid or the like reinforcing material generally extend horizontally over a number of modular wall blocks in a course of such blocks, and the comb-like connection devices can laterally span the gap between juxtaposed blocks. Thus, the connection of the geogrid to the retaining wall also functions to lock adjacent blocks to each other, further strengthening the integrity of the retaining wall formed therefrom.

While the modular wall block system of the '525 and '460 patents is commercially effective for many applications, it cannot be used in a cut wall environment because the depth of fill behind the blocks can seldom accommodate sufficient length of tie-back material to adequately reinforce the retaining wall, particularly if the wall is of any significant height. Therefore, there remains a need for a system adapted to reinforce a retaining wall formed of modular wall blocks in an area of limited depth.

SUMMARY OF THE INVENTION

Accordingly, it is a primary object of the invention to provide a system adapted to reinforce a modular wall block retaining wall in a cut wall environment which obviates the above and other problems with prior art approaches to this problem.

More specifically, the instant inventive concepts orient tie-back sheets vertically, rather than horizontally, to form semi-circular hoops or arched confinement zones, and securely attaches the edges of the hoops to the rear or sides of selected, generally laterally spaced, precast concrete modular wall blocks in one or more courses of a reinforcing wall, the confinement cells receiving soil or other aggregate fill material to effectively support the retaining wall in the limited area available in a cut wall environment.

The tie-back sheet material may be secured to the modular wall blocks in a number of ways. For example, arches sheets of vertically-oriented lengths of geogrid or other tie-back sheet material can be anchored to the rear or side faces of selected wall blocks in a course of modular wall blocks by engaging opposite edge portions of the sheet in vertically extending channels defined in the wall blocks, with the edge portions retained in the channels with or without the aid of an interference rod as disclosed in U.S. Pat. No. 4,824,293, the subject matter of which is incorporated herein by reference. Alternatively, the fingers of a comb-like rigid grid connection device of the type used in the '525 and '460 patents may be driven through the apertures in the edge portions of the geogrid into vertically extending slots or grooves formed in the side or rear surface of selected modular wall blocks to capture the strands of the geogrid between the spine of the grid connection device and the surface of the wall block.

To further unify and integrate the wall blocks in each course, a rigid rod or rebar may be seated in aligned grooves formed in the top surfaces of the blocks. This interconnection between juxtaposed blocks in a course of blocks locks the blocks in position, enhancing the reinforcement of the retaining wall and facilitating the accurate positioning of the front faces of the wall blocks relative to each other.

In the preferred method of constructing a retaining wall according to the inventive concepts of the present invention, a toe pad is cast of concrete so as to provide a foundation for a first course of wall blocks. A plurality of modular blocks are then horizontally positioned on the toe pad to form the initial course of the retaining wall and a rebar is laid across the aligned grooves in the top surfaces of the blocks to interconnect the blocks and minimize relative movement.

Preferably, uniaxially oriented integral sheets of geogrid made by the process of the '798 patent are arranged with their relatively thicker and less oriented bars extending vertically and their molecularly oriented strands extending horizontally and circumferentially to form semi-circularly curved confinement cells behind selected blocks at a depth of approximately 35–45% of the total height of the to-be-formed retaining wall.

The bars at opposite ends of the sheets of grid may be slid into vertically extending channels in selected spaced wall blocks in the manner of the '293 patent. Alternatively, the edge portions of the sheets of the geogrid may be secured to selected blocks by comb-like grid connection devices engaged in vertical slots in the blocks in the manner of the '525 and '460 patents.

Fill material is then deposited within the confinement cells at the rear faces of the blocks in the first course. The depth of the confinement cells is generally less than the space between the modular wall blocks and the cut wall and the height of the confinement cells is generally less than the height of a course of modular wall blocks. Backfill material is then deposited on top of and between each of the confinement cells to a height approximately 4 inches above the uppermost edge of the confinement cells, and behind each cell to fill the area between the cell and the cut wall.

Additional courses of modular wall blocks are superimposed on the first course and provided with filled confinement cells in a similar manner, the superimposed blocks preferably being laterally staggered, and the front faces of succeeding courses being vertically aligned or set-back. To assist in interlocking the blocks in each course laterally, and/or positioning and interlocking superimposed courses with each other, the comb-like connection devices, of the '525 and '460 patents, can be utilized, if desired, with or without the locating tabs or slats for aligning or offsetting the front faces.

By the creation of confinement cells and successive filling of superimposed courses of such cells with layers of fill material, juxtaposed blocks are interlocked with respect to one another side to side (aided by the bar extending through the groove in the top surfaces of the blocks) and top to bottom as the staggered, offset blocks are raised in height to form the retaining wall. In this manner, a reinforced modular wall block retaining wall may be constructed in an area of limited depth with greatly reduced cost as compared to the systems using concrete structural panels.

It is, therefore, another object of the present invention to provide a highly efficient method for erecting a retaining wall in an area of limited depth by the sequential formation of courses of semicircular fill-containing confinement cells projecting from the rear faces of selected precast concrete modular wall blocks in superimposed rows of such blocks.

A further object of this invention is the formation of confinement cells from sheets of grid-like material, preferably uniaxially oriented integral geogrid sheets, the ends of which are anchored to opposite sides of selected spaced wall blocks. The confinement cells can be formed from a sheet of grid-like material with a layer of geofabric or the like located interiorly of the grid to minimize loss of fill, if desired.

It is still another object of the present invention to provide a retaining wall formed of a plurality of courses of modular wall blocks having arched confinement cells extending rearwardly into the fill material, with opposite edge portions of sheet-like material defining the confinement cells being secured by an interference fit in vertical channels defined in a side or rear face of the spaced wall blocks, or by a comb-like grid connection device having spaced fingers engageable through openings in the sheet-like material to be frictionally engaged in vertical slots or grooves in the blocks.

These and other objects of the invention, as well as many of the attendant advantages thereof, will become more readily apparent when reference is made to the following description taken in conjunction with the accompanying drawings.

DETAILED DESCRIPTION OF THE PREFERRED EMBODIMENTS

Figure 1:
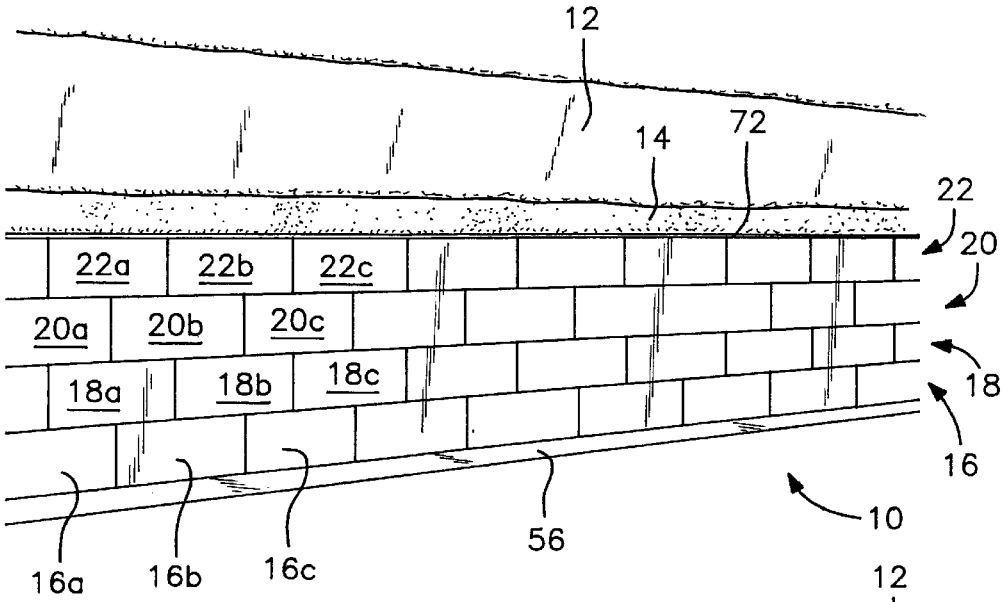
FIG. 1 is a perspective view of a modular block retaining wall according to the instant invention erected in a cut wall environment of limited depth area.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 6:
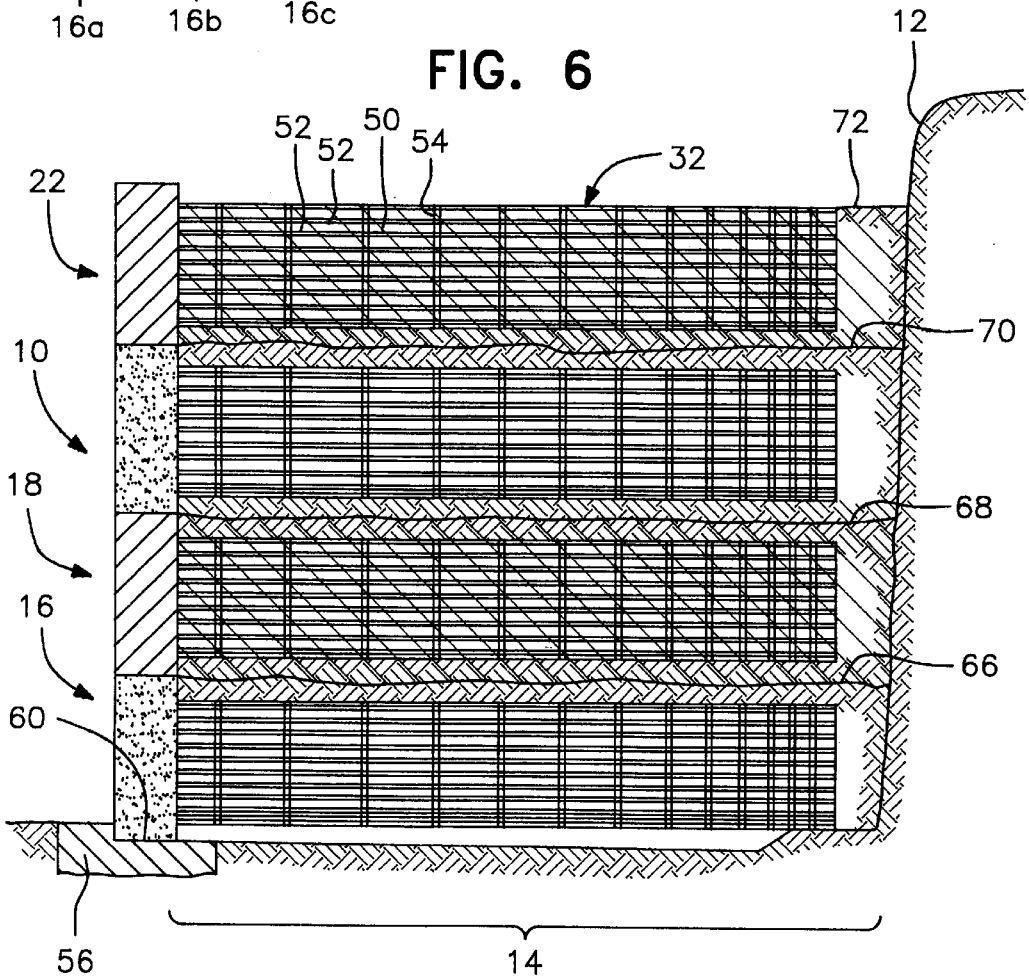
FIG. 6 is a vertical cross-sectional view through a plurality of confinement cells in superimposed courses of wall blocks.

With reference to the drawings in general, and to FIGS. 1 and 6 in particular, a retaining wall embodying the teachings of the subject invention is generally designated as 10. The retaining wall 10 is located in front of an embankment or cut wall face 12 with a limited depth 14 for fill material between the retaining wall and the embankment, making the conventional use of a plurality of vertically spaced, generally horizontally extending, layers of tie-back sheet material, impractical.

The retaining wall 10 is made up of a plurality of courses 16, 18, 20, 22 of precast concrete wall blocks 16*a*, 16*b*, 16*c*, . . . , 18*a*, 18*b*, 18*c*, . . . , 20*a*, 20*b*, 20*c*, . . . , and 22*a*, 22*b*, 22*c*, . . . , for example. It is understood that the dimensions of the wall blocks may vary without departing from the principles of this invention.

In the remaining Figures, selected courses of wall blocks are shown as having two horizontally spaced, rearwardly extending, confinement cells formed behind them. It is understood, however, that the number and spacing of the confinement cells, as well as the size of the modular wall blocks and the numbers of courses of blocks in a particular retaining wall may be modified to accommodate engineering and aesthetic requirements.

Figure 2:
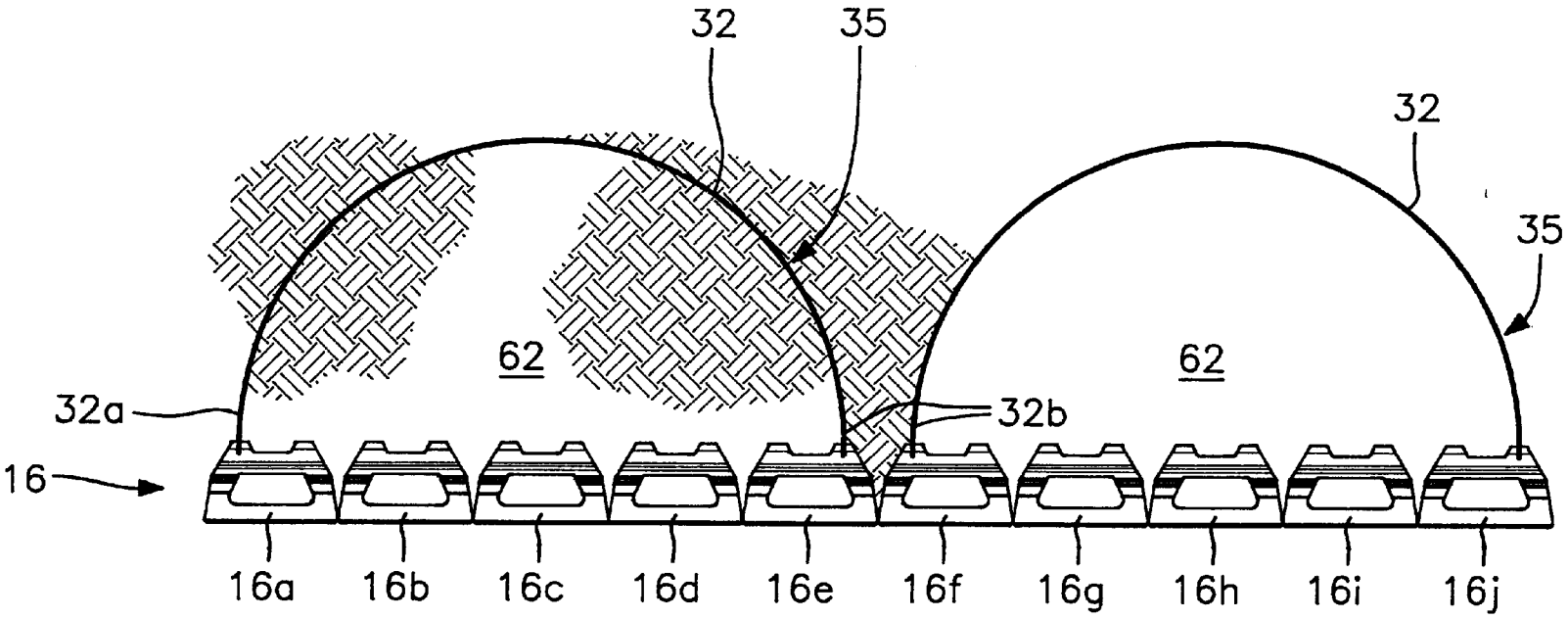
FIG. 2 is a plan view of a plurality of modular wall blocks forming a single course of a retaining wall and illustrating two semi-circular shaped confinement cells extending from a rear face thereof according to this invention.
Figure 4:
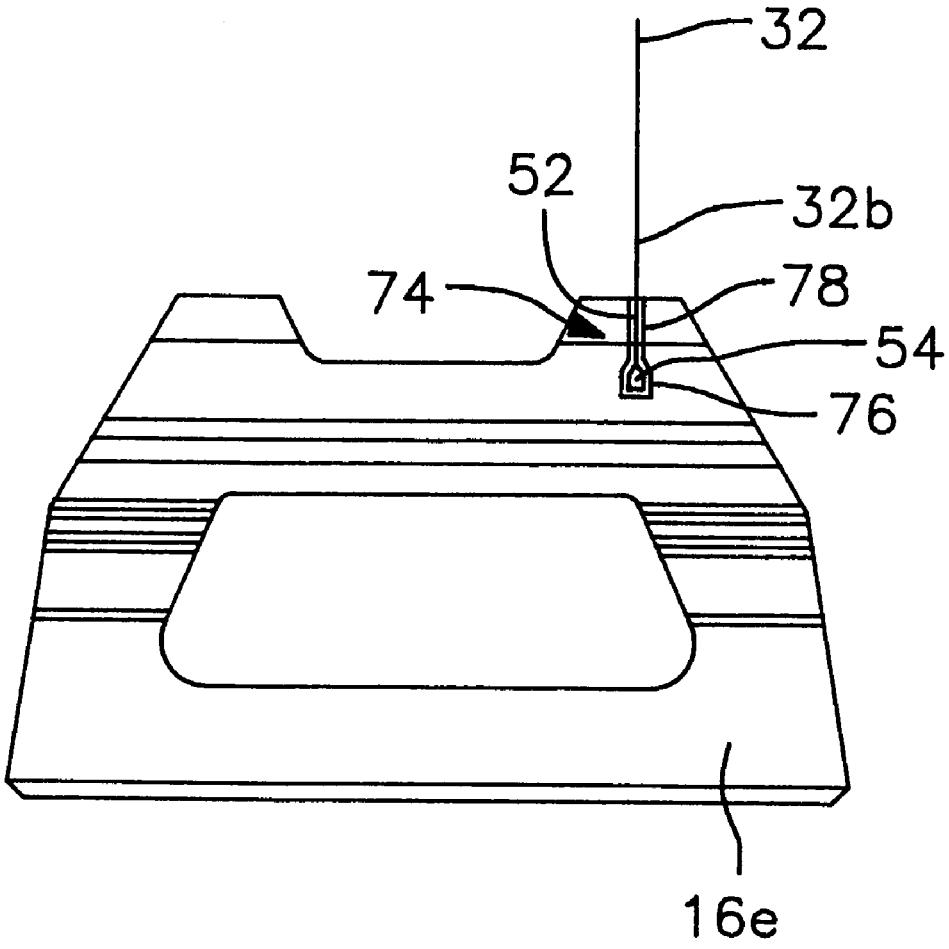
FIG. 4 is a fragmentary plan view of one of the wall blocks illustrating the manner in which the enlarged bar in the edge portions of a uniaxially oriented integral geogrid forming the confinement cell may be secured in a vertically extending channel formed therein.

The first course of wall blocks, ten of which are shown in FIG. 2 at 16*a*–16*j*, are positioned on the toe pad 56 with the opposite edge portions 32*a* and 32*b* of lengths of geogrid or the like 32 secured in channels 74 formed in the rear walls of selected blocks, or all of the blocks, by a mechanical connection. As shown in more detail in FIG. 4 with reference to block 16*e*, the channel 74 extends vertically and includes an enlarged portion 76 defined interiorly of the block and a reduced width passage 78 which communicates with the portion 76 and the rear wall of the block. A bar 54 of a sheet of geogrid 32 is slid into the enlarged portion 76 with the strands 52 fitting in the passage 78. Since the thickness of the bar 54 is greater than the width of the passage 78, the end 32*b* of a length of geogrid 32 is restrained from pulling out from the vertically extending channel 74 in the block. Similarly, the opposite end 32*a* of the length of geogrid 32 is restrained in a vertically extending channel 74 in block 16*a*. As fill material 62, such as soil, is deposited into each cell 32, the tie-back sheets are uniformly outwardly flexed about their circumference to create symmetrically formed, semi-circular arches or confinement cells 35.

Figure 3:
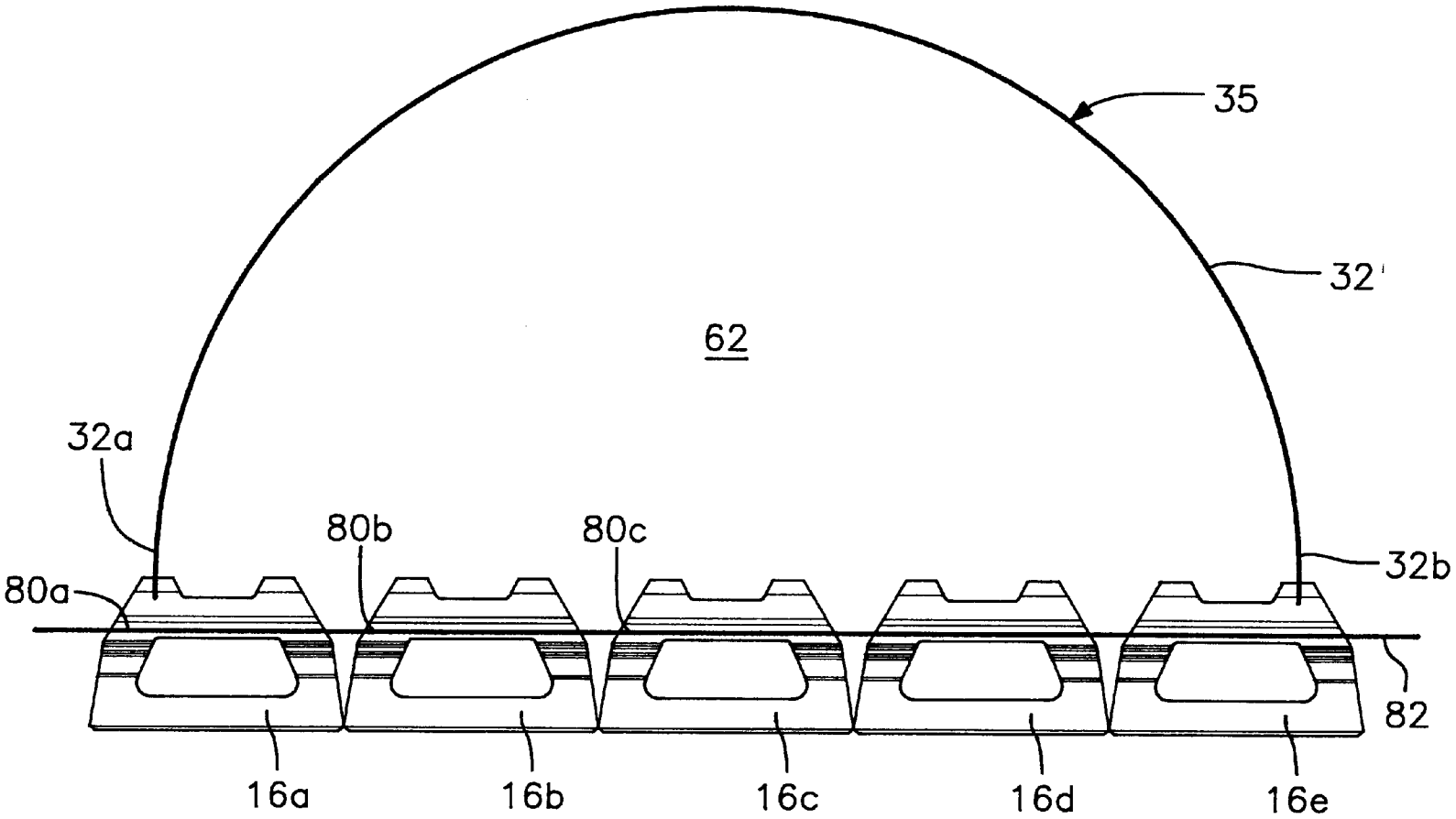
FIG. 3 is an enlarged detailed plan view of one of the confinement cells shown in FIG. 2 and including a rebar positioned in aligned grooves in the top surfaces of each of the blocks to position and interconnect the blocks in a course to each other.

In a preferred embodiment of the modular wall blocks of this invention, to interconnect a plurality of blocks 16*a*, 16*b*, 16*c*, . . . , in a straight section of a course of blocks, each block includes a horizontally extending groove 80 in an upper surface. An elongated rod, such as a rebar 82, extends through the aligned grooves 80*a*, 80*b*, 80*c*, . . . , in juxtaposed wall blocks in a course of wall blocks as seen in FIG. 3, to span the gap between the blocks and thereby interconnect and laterally align the wall blocks in each course. Of course, if the retaining wall is to be curved or angled, connecting rods of limited length will have to be used, or the connecting rods will have to be eliminated.

As noted, the preferred cell-defining material comprises a uniaxially oriented geogrid formed by stretching an apertured plastic sheet material as disclosed in the '798 patent to produce a multiplicity of molecularly-oriented elongated strands and transversely extending bars, which are substantially unoriented or less-oriented than the strands, together defining a multiplicity of grid openings. Biaxial geogrids, wherein the bars are also formed into oriented strands, are also useful as are grid materials formed of various polymers including the polyolefins, polyamides, polyesters and the like or fiberglass, may be used. In fact, any grid-like sheet material, including steel (welded wire) grids capable of being secured to the wall blocks of the instant invention in the manner disclosed herein are suitable. Such materials are referred to herein and in the appended claims as "grid-like sheets of material".

Figure 5:
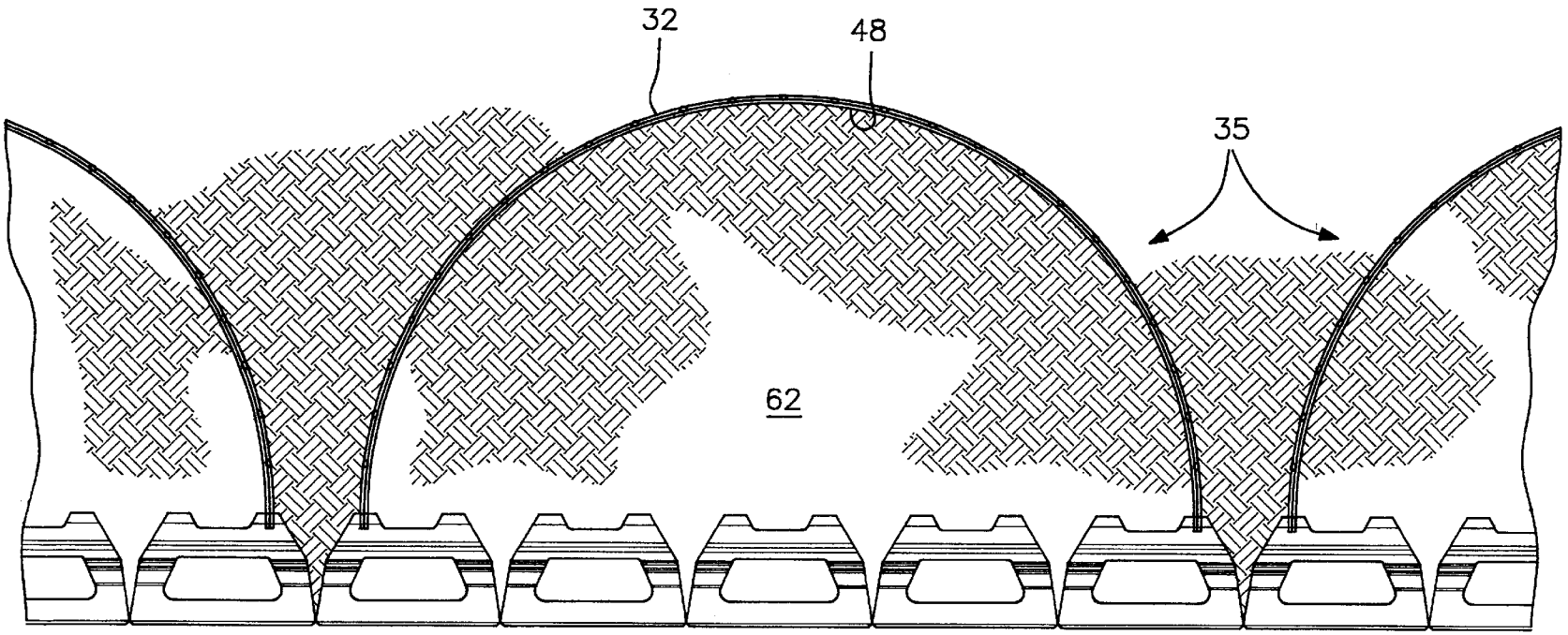
FIG. 5 is a fragmentary plan view illustrating the formation of confinement cells incorporating a geotextile liner material to minimize loss of soil fill and enhance the reinforcement.
Figure 7:
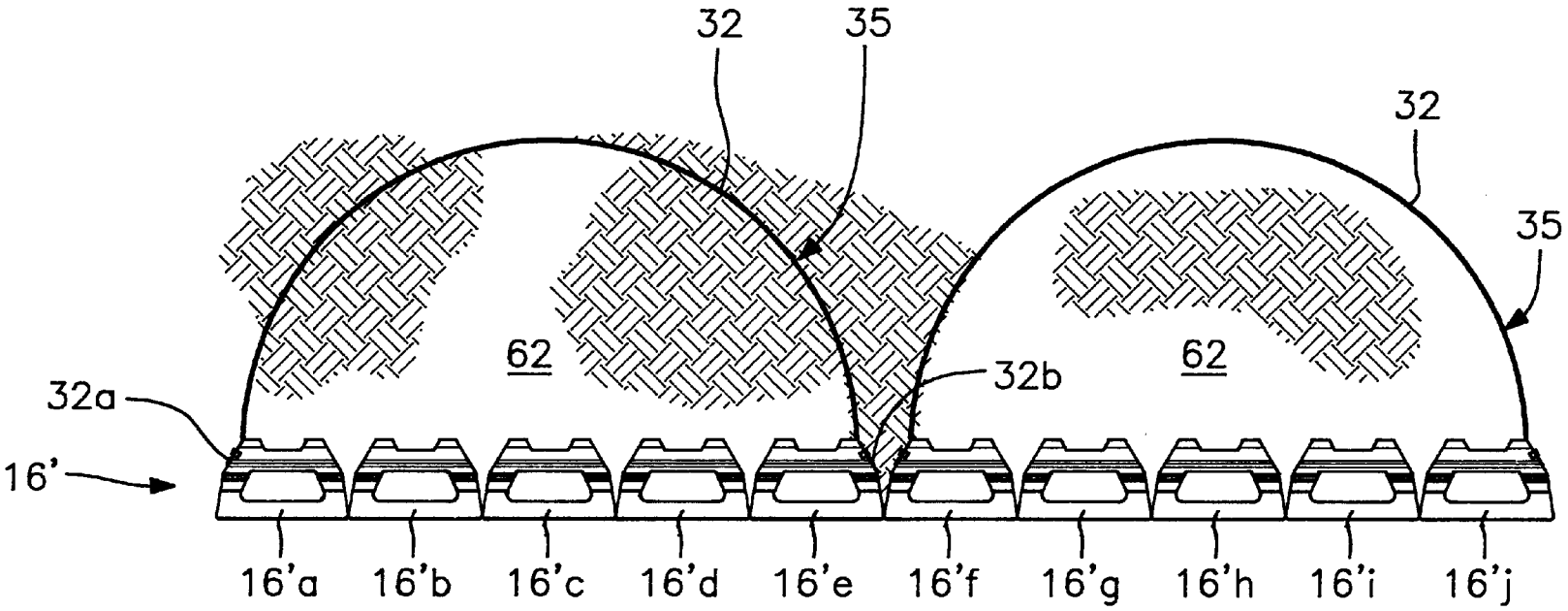
FIG. 7 is a plan view, similar to FIG. 2, schematically showing the manner in which the edge portions of the confinement cells may be secured to selected wall blocks utilizing comb-like grid connection devices.

If the fill-material is of a size smaller than the apertures of the geogrid or other grid-like sheet, a geofabric, such as seen at 48 in FIG. 5, may be used to line the geogrid. Preferably the geofabric is secured to the geogrid by fasteners (not shown) or by heat bonding to form a geogrid/fabric composite. Particularly desirable grid composites are described in U.S. Pat. Nos. 5,199,825 and 5,277,520, assigned to Tensar, the disclosure of each of which is incorporated herein in its entirety by reference. The preferred grid composite is formed of an integral polymer grid which is typically heat bonded to a 4 to 8 oz./yd.$^2$, 100% continuous filament polyester, non-woven needle punched engineering fabric. The engineering fabric or geotextile may be bonded to the polymer grid using an open flame heat source or by the use of a heated roll. Such grid composites are available from Tensar under product number GC 1200 or G 3320.

Various bonded composite open mesh structural textiles, including woven or knitted grid-like sheets such as disclosed in co-pending U.S. patent application Ser. Nos. 08/643,182 and 08/696,604 filed May 9, 1996 and Aug. 14, 1996, now U.S. Pat. No. 5,795,835 issued Aug. 18, 1998, respectively, assigned to Tensar, the subject matter of each of which is incorporated herein in its entirety by reference, may be readily adapted for use as the tie-back means for forming the confinement cells or as the grid element of a composite matrix material according to this invention. For example, high strength woven or knitted structural textiles, such as disclosed in co-pending U.S. patent application Ser. No. 08/696,603, assigned to Tensar, the disclosure of which is incorporated herein by reference, or the aforementioned application Ser. No. 08/696,604, now U.S. Pat. No. 5,795,835, provide satisfactory tensile properties for use instead of a grid composite.

It is even possible to fill a cell formed by a grid-like sheet of material having apertures larger than the fill material without a geofabric due to the "arching" effect of fill material passing through openings in the grid. As is known, soil or the like will eventually form small arches projecting through the openings of the grid which will prevent the passage of further fill material.

It is also possible to use imperforate or substantially imperforate sheets of flexible polymer or the like that can be secured in a slot in the rear face of the wall blocks by an interference rod or the like (not shown). Alternatively, apertures can be provided in the edge portions of such tie-back sheets to enable attachment to the modular wall blocks with the use of a comb-like grid connector as described above.

While imperforate sheets of material preclude the loss of fill material since there are no openings between strands as in the grid-like cell-forming materials, thereby avoiding the need to rely on the use a geofabric or "arching" of the fill, the uniaxially stretched integral geogrids preferred herein still provide substantial advantages due to the very high strength of the molecularly oriented strands which extend in the circumferential direction of the primary tension created in the arched confinement cells. With such materials, lengths of geofabric 48 preferably line the interior of the geogrid, as shown in FIG. 5.

Referring now particularly to FIGS. 7 through 11, an alternate means to connect a length of geogrid 32 or a geogrid/geofabric composite to selected wall blocks is shown. In this embodiment, the edge portions 32*a*, 32*b* of the geogrid 32 are secured by engagement of comb-like grid connection devices such as described in the '525 and '460 patents and illustrated at 88 in FIG. 11. The grid connectors 88 each comprise a spine 90 with a plurality of spaced fingers 92, preferably including serrations 98 adapted to frictionally engage the side walls 102, 104 of vertically extending slots or grooves 100 formed in the side or rear surfaces of selected spaced blocks 16'*a*, 16'*e* and 16'*f*, 16'*j* of a first course 16' of a plurality of wall blocks. Of course, slots 100 may be provided in all of the modular wall blocks for ease of manufacture. The spine 90 of the grid connection device 88 spans the strands 52 of the grid 32 so as to attach the end portions of the grid 32 to the selected wall blocks.

Figure 8:
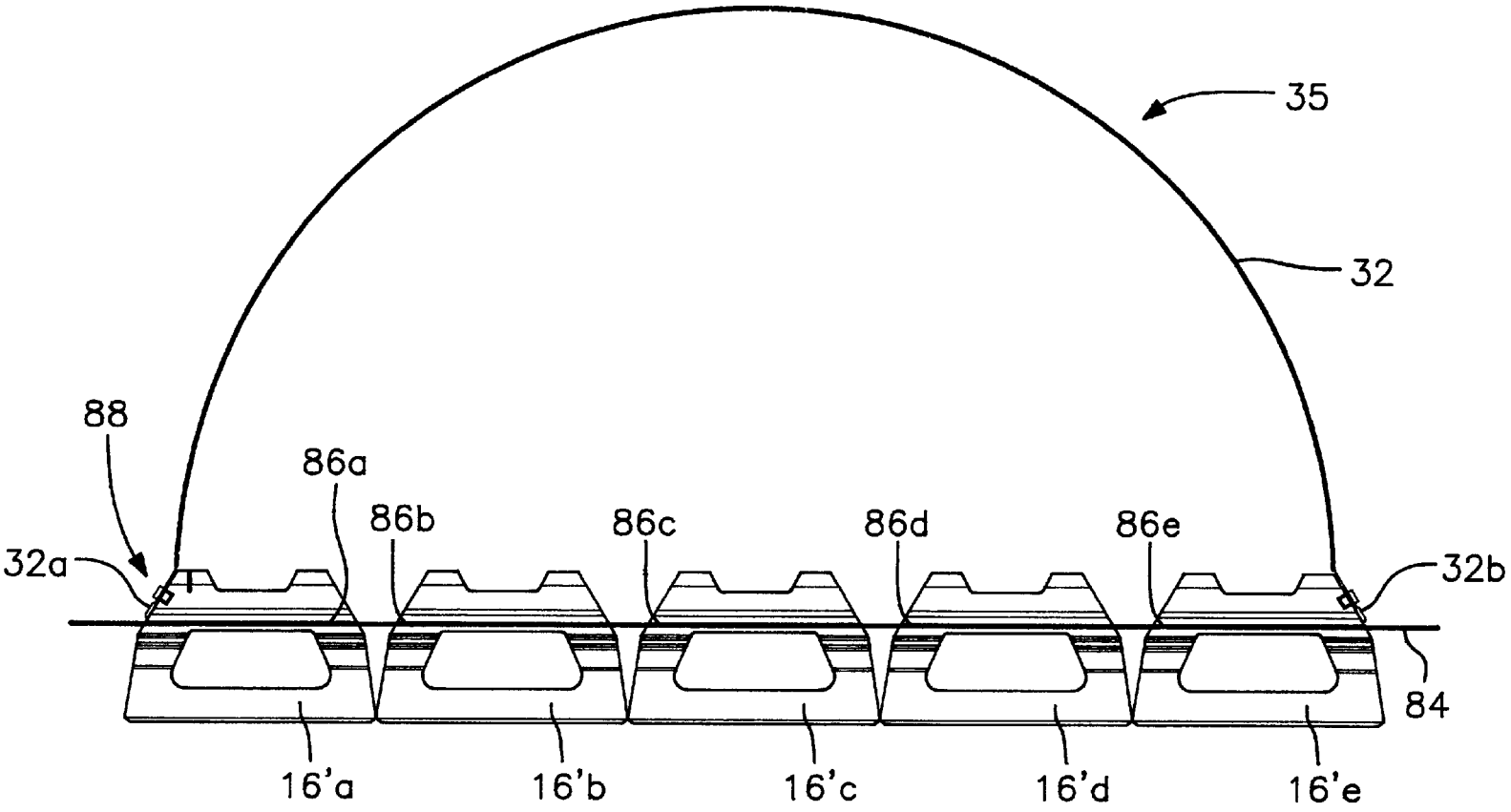
FIG. 8 is a view, similar to FIG. 3, but further illustrating the connection means of FIG. 7.
Figure 9:
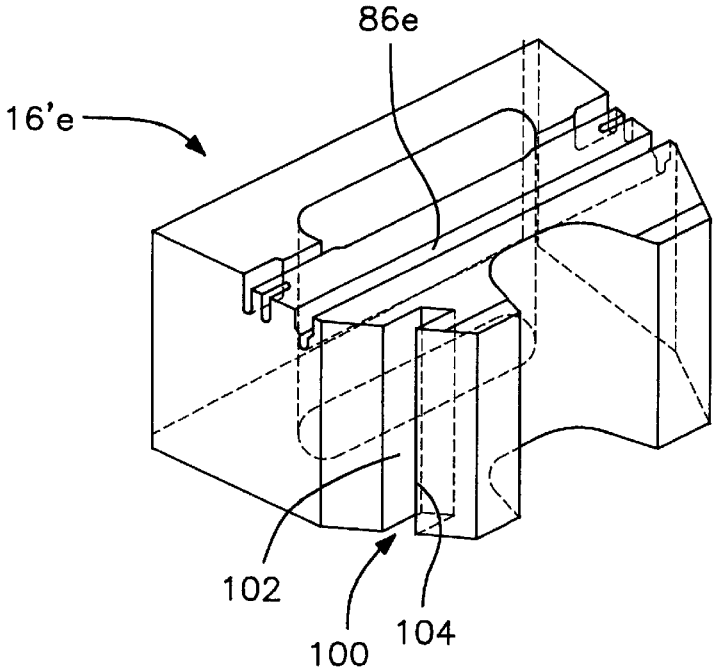
FIG. 9 is an enlarged perspective view of a single wall block of the type used in connection with a comb-like grid connection device, wherein a vertically extending slot or groove is provided in one side surface of the wall block, it being understood as being within the scope of the present invention that the slot could be located in the opposite side of the block, or slots can be included in both sides of the wall block for ease of manufacture.
Figure 10:
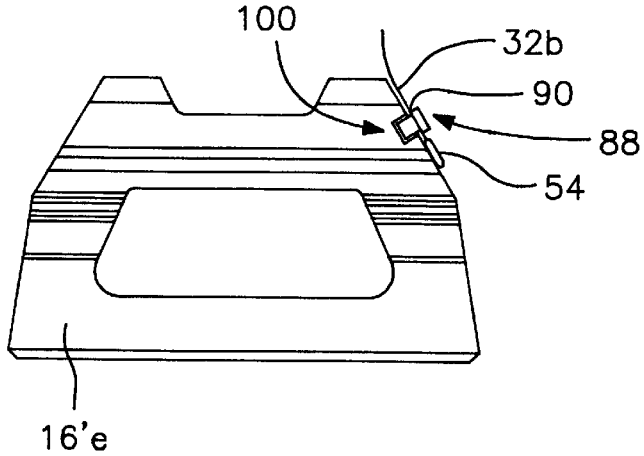
FIG. 10 is a view similar to FIG. 4, but showing in further detail the manner in which the grid connection device secures edge portions of a geogrid or the like to a modular wall block of the type seen in FIG. 9.
Figure 11:
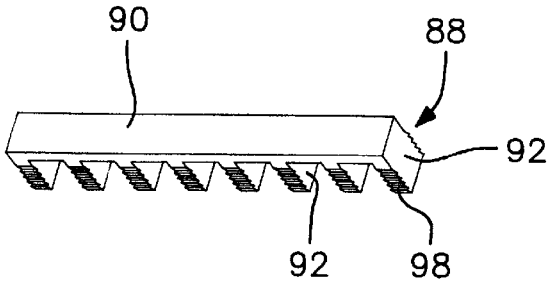
FIG. 11 is an enlarged perspective view of the preferred comb-like grid connection device.

As shown in FIG. 8, a plurality of the blocks in course 16', may be interconnected by a rebar 84, extending through grooves 86*a*, 86*b*, . . . , formed in the top surfaces of the blocks.

In the construction of a retaining wall according to the principles of the present invention, and the embodiments disclosed in FIGS. 2–4 and 7–11, a concrete toe pad 56 is preferably first cast in place, spaced from an embankment or cut wall face 12. The toe pad 56 generally includes an offset portion 60 receiving the first course 16 of wall blocks. Once the cell-forming material 32 is attached to selected spaced blocks, the confinement cells 35 are filled with particulate material until the cells assume a semi-circular arched condition.

When the first course of confinement cells have been filled, the remainder of the area between and behind the cells is filled to a level 66 above the upper surface of the cells as shown in FIG. 6. Additional courses of wall blocks 18, 20, 22 are then constructed with confinement cells filled to the levels 68, 70 and 72, respectively, to complete the reinforced modular wall block retaining wall 10.

Preferably, the wall blocks in superimposed courses are staggered as seen in FIG. 1. The front faces may be aligned vertically as illustrated, or offset rearwardly (not shown) as desired. The spacing and number of confinement cells may be varied and is not necessary to include confinement cells in each course, particularly if the retaining wall is of limited height.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A fill material confinement cell comprising:

a plurality of modular wall blocks, each having front and rear surfaces, and upper and lower surfaces, said wall blocks being stacked in superimposed courses such that said front surfaces together define a front face of a retaining wall, vertically oriented sheets of material having opposed edge portions secured respectively to, and extending from, said rear surfaces of selected spaced wall blocks of said plurality of wall blocks in at least some of said courses to define confinement cells, said confinement cells being filled with particulate material so as to uniformly outwardly flex said sheets of material, said sheets of material are grid-like sheets of material each defining a multiplicity of openings, vertically extending slots defined in said rear surfaces of said selected wall blocks, and grid connection devices each including a spine portion and a plurality of finger elements extending therefrom, said finger elements being spaced apart for reception through openings in edge portions of said grid-like sheets and frictionally retained in said slots.

2. A fill material confinement cell as claimed in claim 1, wherein said upper surfaces of each block includes a groove extending transversely across the full width of each block, further including an elongated rod received in aligned grooves in a plurality of said blocks to interconnect and locate blocks in each course.

3. A fill material confinement cell as claimed in claim 1, wherein said grid-like sheets of material are uniaxially stretched polymer geogrids and said openings are defined by a plurality of molecularly oriented elongated strands interconnected by transversely extending elements.

4. A fill material confinement cell as claimed in claim 3, wherein said transversely extending elements are thickened bars.

5. A retaining wall comprising:

a cut wall face, a plurality of courses of vertically stacked modular wall blocks, each wall block having vertically extending front and rear surfaces, said front surfaces together defining a front face of said retaining wall, and said rear surfaces being spaced from said cut wall face, vertically oriented arched sheets of material having opposed edge portions secured respectively to, and extending rearwardly from, said rear surfaces of selected spaced wall blocks in at least some of said courses to define confinement cells between said rear surfaces of said wall blocks and said cut wall face, and particulate fill material contained within said cells so as to uniformly outwardly flex said sheets of material, said sheets of material being grid-like sheets of material each defining a multiplicity of openings, vertically extending slots defined in said rear surfaces of said selected wall blocks, and grid connection devices each including a spine portion and a plurality of finger elements extending therefrom, said finger elements being spaced apart and received through openings in edge portions of said gridlike sheets and frictionally retained in said slots.

6. A retaining wall as claimed in claim 5, further including additional fill material between said cells and between said cells and said cut wall face.

7. retaining wall as defined in claim 5, wherein said wall blocks in juxtaposed courses are laterally staggered with respect to each other.

8. A retaining wall as claimed in claim 5, wherein said upper surfaces of each block includes a groove extending transversely across the full width of each block, further including an elongated rod received in aligned grooves in a plurality of said blocks to interconnect and locate blocks in each course.

9. A retaining wall as claimed in claim 5, wherein said grid-like sheets of material are uniaxially stretched polymer geogrids having a plurality of molecularly oriented elongated strands interconnected by transversely extending elements together defining said openings.

10. A retaining wall as claimed in claim 9, wherein said transversely extending elements are thickened bars.

11. A method of building a retaining wall, said method comprising:

aligning a plurality of modular wall blocks to form a first course of such blocks, securing opposite edge portions of sheets of material in a vertical orientation to extend from rear surfaces of selected spaced blocks in said course to form confinement cells between said rear surfaces and said sheets of material, filling said confinement cells with fill material so as to outwardly flex said sheets of material, and constructing further courses of modular wall blocks and providing selected courses with confinement cells in a similar manner to the predetermined height of the retaining wall, said sheets of material being grid-like sheets of material each defining a multiplicity of openings, vertically extending slots being defined in said rear surfaces of said selected wall blocks, and grid connection devices each including a spine portion and a plurality of finger elements extending therefrom, said finger element being spaced apart, and engaging said finger elements through openings in edge portions of said grid-like sheets and frictionally retaining said finger elements in said slots.

12. A method of building a retaining wall as claimed in claim 11, further including filling any remaining space between said sheet of material and said cut wall face with fill material.

13. A method of building a retaining wall as claimed in claim 11, wherein a maximum depth of the space between said rear face and said sheet of material is in the range of 35 to 45% of said predetermined height.

14. A method of building a retaining wall as claimed in claim 11, wherein said upper surfaces of each block includes a groove extending transversely across the full width of each block, further including an elongated rod received in aligned grooves in a plurality of said blocks to interconnect and locate blocks in each course.

15. A method of building a retaining wall as claimed in claim 11, wherein said grid-like sheets of material are uniaxially stretched polymer geogrid having a plurality of molecularly oriented elongated strands interconnected by transversely extending elements together defining said openings.

16. A method of building a retaining wall as claimed in claim 15, wherein said transversely extending elements are thickened bars.

* * * * *